United States Patent [19]

Wagor

[11] 4,228,621

[45] Oct. 21, 1980

[54] VALVE SURFACING MACHINE WITH VARIABLE SPEED CHUCK

[75] Inventor: John C. Wagor, Cedar Rapids, Iowa

[73] Assignee: Kwik-Way Manufacturing Company, Marion, Iowa

[21] Appl. No.: 13,930

[22] Filed: Feb. 22, 1979

[51] Int. Cl.[3] ..... B24B 19/00

[52] U.S. Cl. ..... 51/241 VS

[58] Field of Search ..... 51/105 VG, 89, 118, 51/145 R, 241 VS

[56] References Cited

U.S. PATENT DOCUMENTS

| | | | |
|---|---|---|---|
| 1,256,185 | 2/1918 | Tripp | 51/105 VG |
| 1,431,644 | 10/1922 | Fletcher | 51/105 VG |
| 1,909,446 | 5/1933 | Albertson | 51/105 VG |
| 2,092,117 | 9/1937 | Hall | 51/105 VG |
| 2,221,918 | 11/1940 | Hall et al. | 51/105 VG |
| 2,606,767 | 8/1952 | Preston | 51/105 VG |
| 3,029,564 | 4/1962 | Humbert | 51/105 VG |
| 3,550,323 | 12/1970 | Balsiger | 51/105 VG |

*Primary Examiner*—Othell M. Simpson
*Assistant Examiner*—Roscoe V. Parker
*Attorney, Agent, or Firm*—Hill, Van Santen, Steadman, Chiara & Simpson

[57] ABSTRACT

An improved automotive valve surfacing machine has a variable speed chuck assembly driven by a variable speed AC gear motor. The speed of the motor is set by a potentiometer. A one-way clutch assembly located between an output shaft of the variable speed motor and the chuck assembly provides a release mechanism whereby the chuck assembly may be freely turned in one direction, using a knob located at one end thereof, to visually inspect the valve surface being surfaced without any drag due to the gear motor.

1 Claim, 4 Drawing Figures

VALVE SURFACING MACHINE WITH VARIABLE SPEED CHUCK

BACKGROUND OF THE INVENTION

1. Field of the Invention

The invention pertains to the field of grinding machines for the purpose of resurfacing automotive valves.

2. The Prior Art

Machines for the purpose of resurfacing automotive valves are known in the prior art. Typical of some of the prior art valve grinding machines are those disclosed in the following prior art patents:

(1) U.S. Pat. No. 3,550,323 to Balsiger which discloses a valve grinding machine suitable for grinding a pair of valves simultaneously.

(2) U.S. Pat. No. 3,029,564 to Humbert which discloses a singular valve grinding machine.

(3) U.S. Pat. No. 2,606,767 to Preston which discloses a singular valve grinding machine.

(4) U.S. Pat. No. 2,221,918 to Hall which also discloses a singular valve grinding machine.

One of the drawbacks with the prior art valve grinding machines has been the fact that with new leaner burning engines and lead free fuels, harder materials are being used in the valve compositions, such as titanium and stellite. Prior art constant speed chucks have required frequency changing of grinding wheels to match the abrasive requirements of particular valve materials. This is a costly and time consuming procedure.

SUMMARY OF THE INVENTION

The invention comprises in combination a variable speed, potentiometer controlled, gear motor coupled through a one way clutch mechanism to the drive shaft of a chuck via a toothed belt. The chuck mechanism has a central shaft supported by a set of bearings. One end of the shaft has a manually rotatable knob thereon. A second end of the chuck shaft supports the chuck itself. The chuck is a spring biased ball detent variety.

A valve stem is inserted into the chuck which under the influence of the biasing spring, locks about the valve stem. The variable speed motor is then set for the desired grinding speed by means of the potentiometer and the valve is moved adjacent to a motor driven grinding wheel of a conventional variety. By means of the variable speed motor the optimal turning speed of the chuck and valve may be set depending on the type of valve being ground and size and composition of the grinding wheel thereby minimizing the need to replace or change grinding wheels.

At an appropriate point when inspection of the ground valve surfaces is required, the chuck motor is turned off. The knob at one end of the chuck shaft may then be rotated freely in one direction, due to the one-way clutch located between the drive motor and the chuck shaft, so that the valve may be optically inspected. When inspection is completed the motor speed may again be set to an optimal value and the grinding process may be resumed.

DETAILED DESCRIPTION OF THE PREFERRED EMBODIMENT

Figure 1:
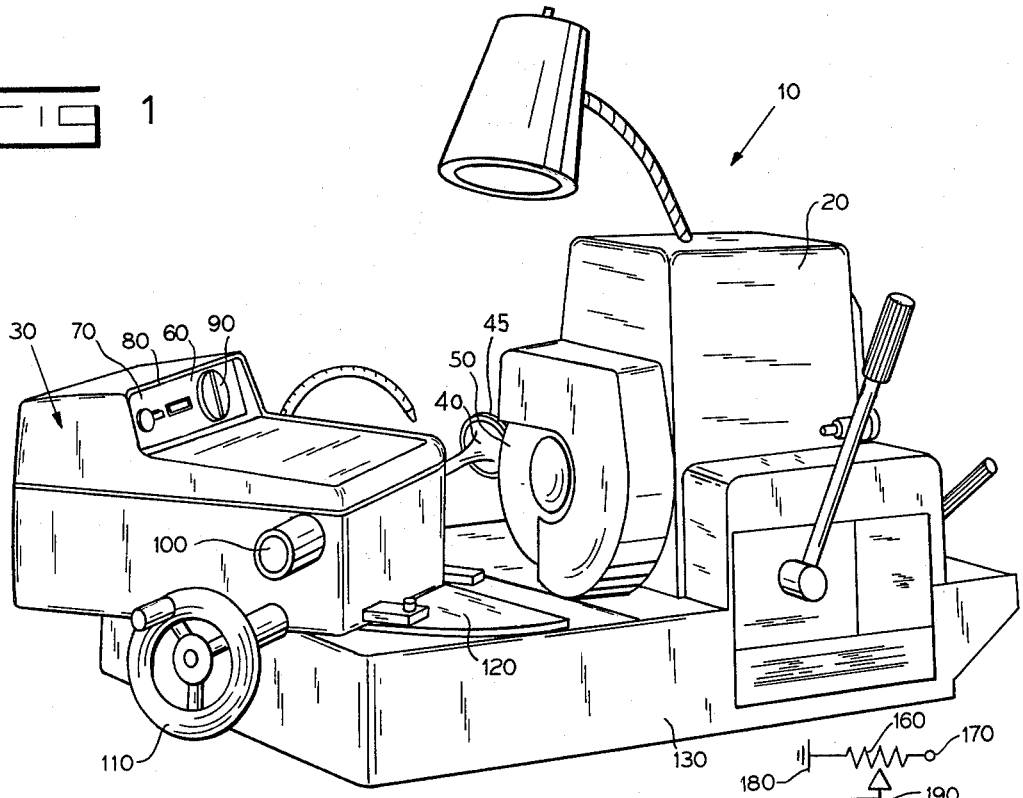
FIG. 1 is a perspective view of a valve grinding machine incorporating the variable speed drive motor and one-way clutch of the present invention.

For the purpose of disclosing the best mode of practicing my invention, so as to enable one of skill in the art to practice it and not by way of limitation, there is shown generally in FIG. 1 a perspective view of a valve grinding machine 10 incorporating my invention. The valve grinding machine 10 incorporates a grinding wheel and drive assembly 20 of a conventional variety which forms no part of the present invention. The grinding machine 10 of FIG. 1 also incorporates a variable speed chuck assembly 30 which does incorporate my invention.

The variable speed chuck assembly 30 supports a valve 40 having a surface 45 to be ground by a grinding wheel 50 in the grinding wheel assembly 20. The variable speed chuck assembly 30 incorporates a set of controls 60 including a chuck release lever 70 an on-off switch 80 and a speed setting control 90.

Additionally, the chuck assembly 30 includes a serrated knob 100 used for optical inspection purposes and a hand crank 110 which is used to adjust the valve 40 with respect to the cutting surface of the wheel 50. The adjustable speed chuck assembly 30 is angularly mounted on a slide 120 which permits the angular position of the valve 40 with respect to the cutting wheel 50 to be adjusted. A base member 130 supports the motor and grinding wheel assembly 20 and the variable speed chuck assembly 30.

Figure 2:
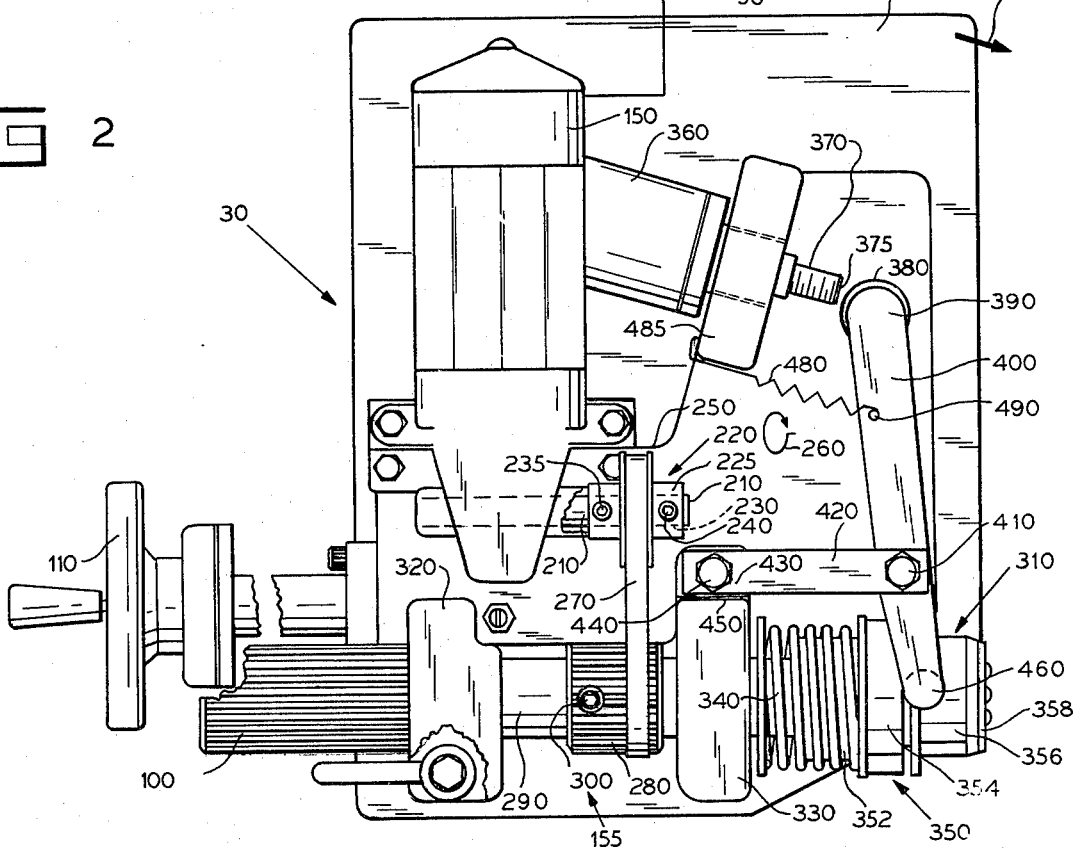
FIG. 2 is a top elevation of the chuck assembly of the grinding machine of FIG. 1 with its cover removed.

With respect to FIG. 2, a top elevation of the variable speed chuck assembly 30, the variable speed chuck assembly 30 is supported on a mounting plate 140 whereon is mounted a variable speed drive motor 150 which drives a chuck assembly 155. The motor 150 is a universal AC gear motor controllable by a potentiometer 160 which is connected between a voltage input terminal 170 and a ground connection 180. Potentiometer 160 has a central wiper 190 connected to the speed control knob 90. The central wiper 190 is electrically connected to the motor 150 by a wire 200. Adjusting the position of the central wiper 190 of the potentiometer 160 varies the potential applied to the motor 150 permitting the speed of an output shaft 210 to be varied over a range of 0–200 RPM. The on-off switch 80 is connected so an operator may turn off the motor 150 to inspect the valve being resurfaced.

The output shaft 210 of the motor 150 is connected to a one-way clutch 220 of the type made by the Thorrington Manufacturing Company. The clutch 220 has cylindrical housing 225 with a cylindrical boring 230 therethrough in which is located the output shaft 210 of the variable speed motor 150. A pair of set screws 235, 240 locks the housing 225 to the shaft 210.

A pulley 250 is affixed to the housing 225. The housing 225 is rotated in a first direction 260 by the shaft 210. The pulley 250 is driven by the housing 225. The pulley 225 carries a drive belt 270. The belt 270 which is of the toothed variety engages a gear member 280 which is locked to a shaft 290 of the chuck assembly 155. The gear member 280 has a serrated upper surface which engages the teeth on the interior surface of the belt 270.

The gear member 280 is locked to the shaft 290 by a set screw 300. The manually turnable adjusting knob 100 is carried on one end of the shaft 290. At the other end of the shaft 290 is a spring biased chuck assembly 310 for supporting the valve stem of the valve to be resurfaced. A pair of support members 320 and 330 supports the ends of the shaft 290.

The spring biased chuck assembly 310 includes a biasing spring 340 and a three-part unlocking assembly 350. The spring 340 is located between the support member 330 and the unlocking assembly 350. The valve unlocking assembly 350 has a tubular portion 352 which extends partially under the spring 340, a middle locking ring 354 and an exterior ring member 356. A surface locking plate 358 is adjacent the ring member 356.

The valve which is to resurface is released from within the chuck assembly 310 by means of a hydraulic or pneumatic transducer 360 having an output shaft 370 which is displaceable and which has a surface 375 which can in a controlled fashion be driven against a cam surface 380 which is rotatably affixed to an end 390 of a lever arm 400. The arm 400 is permitted to pivot about a point 410 by a second stationary lever arm 420 which has an end 430 retained by a bolt 440 to an end 450 of the housing 330. A second end 460 of the lever 400 engages the exterior ring member 356 of the chuck assembly 310.

As the shaft 370 of the transducer 360 moves laterally with respect to the body member of the transducer 360 in a direction 470, the end 375 engages the rotatably mounted cam surface 380. A spring member 480 affixed on one end to an edge 485 of the transducer 360 and to a connecting point 490 of the elongated arm member 400 biases the roller surface 380 toward the end surface 375 of the output shaft 370 of the transducer 360. As the end 375 of the shaft 370 bears against the rotatably mounted cam surface 380 the end 390 of the elongated member 400 moves generally in the direction 470 thereby causing the other end 460 of the elongated member 400 to press against the exterior ring member 356 thereby compressing the biasing spring 340 of the chuck assembly 310 which results in the chuck assembly 310 releasing the valve to be resurfaced. When the shaft 370 of the transducer 360 moves opposite to the direction 470 the biasing spring 340 drives the exterior ring member 356 away from the support member 330 thereby locking the chuck assembly 310, gripping the valve stem, thus permitting the valve to be resurfaced.

Figures 3, 4:
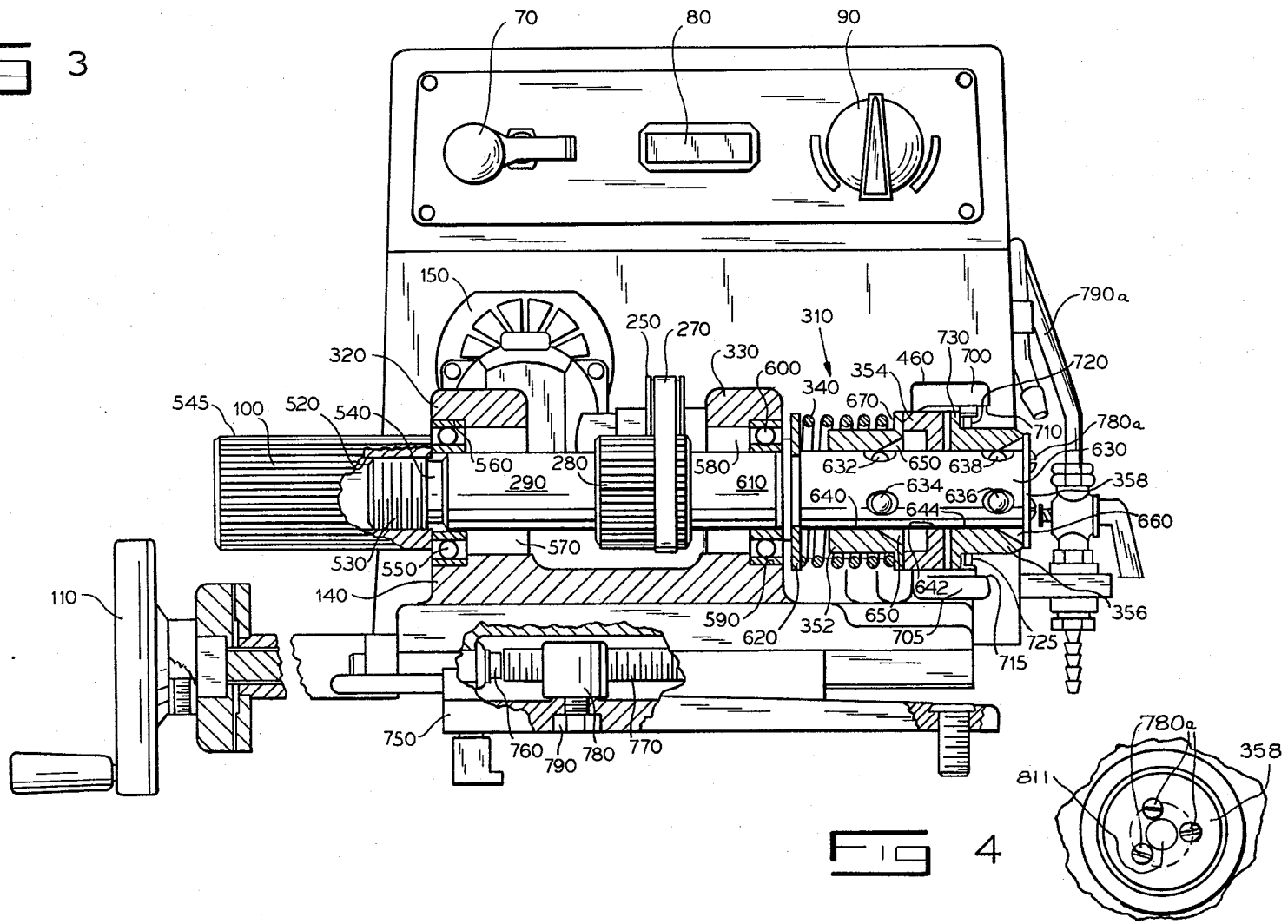
FIG. 3 is a front elevation of the chuck assembly of the valve grinding machine of FIG. 1, with some of the supporting members partly broken away, showing the internal structure thereof.
FIG. 4 is a side elevation of the chuck assembly of FIG. 3.

FIG. 3 discloses additional details of the chuck assembly 310. The manually rotatable inspection knob 100 has a cylindrical boring 520 partly therethrough with a set of threads which engage a set of threads 530 on an end 540 of the chuck shaft 290. The knob 100 has a longitudinal set of serrations 545. The end 540 of the chuck shaft 290 is supported by a roller bearing assembly 550 retained within a slot 560 in the support assembly 320. The support assembly 320 has a cylindrical boring 570 through which passes the shaft 290. In a similar fashion the support member 330 has a cylindrical boring 580 and a retaining groove 590 which supports a second roller bearing assembly 600 whose purpose is to support a second end 610 of the shaft 290.

Affixed to the second end 610 is the chuck assembly 310. The chuck assembly 310 has a retaining ring 620 affixed at one end thereof. A chuck mechanism 630 of the ball detent variety is affixed to the end 610 of the shaft 290 in a convention fashion. The ball detent chuck 630 has a series of balls 632, 634, 636 and 638 each located in an adjacent slot in the surface of the chuck 630. The chuck 630 is an elongated cylindrical member with a boring therethrough into which the stem of the valve to be ground or resurfaced is inserted. By depressing the set of balls 632 through 638 the stem of the valve may be gripped so that the valve turns with the chuck assembly 310 under the influence of the variable speed drive motor 150. The tubular portion 352 of the valve unlocking assembly 350 has a boring 640 therethrough through which fits the chuck assembly 630. The middle locking ring 354 and the exterior ring member 356 each have a corresponding boring 642 and 644, all aligned along a common center line with the boring 640 and the chuck assembly 630. Adjacent one end of the boring 640 is a biased surface 650. A second biased surface 660 is located adjacent one end of the boring 644. The biased surfaces 650 and 660 provide regions wherein the balls 632 through 638 may move when the end 460 of the lever arm 400 is forced against the exterior ring member 356 thereby releasing the valve stem which is located in the chuck 630. When the transducer 360 ceases driving the end 460 of the lever arm 400 against the exterior ring member 356, the biasing spring 340 acts between the retaining ring 620 and a surface 670 of the tubular portion 352 thereby forcing the three-part unlocking assembly 350 toward the exterior surface locking plate 358. As a result the borings 640 and 644 press against the surfaces of the balls 632 through 638 respectively thereby relocking the valve stem in the chuck 630.

The end 460 of the elongated member 400 is yolk-shaped and has a top portion 700 and a bottom portion 705. Each of the yolk-shaped ends 700, 705 has an interior surface 710, 715 to which is connected an unlocking pin 720, 725 respectively. The exterior ring member 356 has a flange 730 which is cylindrical and against which the pins 720 and 725 exert pressure when the transducer 360 drives the end 460 of the member 400 so as to compress the spring 340 thereby unlocking the valve stem.

The mounting plate 140 may be moved laterally with respect to a second plate 750 by turning the hand crank 110 which is connected in a conventional fashion to a shaft 760 having a set of threads thereon 770 which extend through a nut 780 which is affixed to the bracket 750 by a bolt 790. The surface locking plate 358 which located at one end of the chuck 630 is retained in place by a pair of screws 780. An oil dispensing mechanism 790 is located adjacent the surface locking plate 358 for the supply of cutting oil during the resurfacing operation.

During operation, an operator inserts the valve stem of the valve to be resurfaced into the chuck 630 and releases the transducer 360 by means of the release lever 70 thereby locking the valve in the chuck assembly 630. The operator then adjusts the speed of rotation of the chuck assembly 310 by adjusting the speed of the motor 150 by turning the knob 90 which is connected to the potentiometer 160. When the valve appears that it might be properly resurfaced the operator turns off the motor 150 by means of the on-off switch 80 and rotates the chuck 630 by turning the serrated knob 100. Because of the presence of the one-way clutch 220 between the output shaft 210 and the shaft 290 of the chuck assembly 155 the operator is able to freely rotate the shaft 290 by means of the knob 100 without any gear drag from the motor 150. When the valve has been fully inspected, the operator can then restart the motor 150 by means of the on-off switch 80 and if necessary, readjust the speed of the motor 150 by the speed setting control 90. When the resurfacing of the valve is completed, the operator releases the valve stem from the chuck 630 by energizing the transducer 360 through the lever 70. When energized, the transducer 360 unlocks the chuck 630 by means of the three-part unlocking mechanism 350 so that the valve may then be removed.

While those skilled in the art might suggest various modifications, changes or equivalent structures it should be understood that I wish to embody within the claims of the patent warranted hereon all such modifications, changes or equivalent structures as reasonably come within my contribution to the art.

I claim:

1. In a valve surfacing machine with a motor driven grinding wheel, a variable speed motor attached to an adjustable means for mounting, and a chuck assembly attached to the adjustable means for mounting, the chuck assembly rotatably grips the stem of the valve to be surfaced and includes means for releasing the stem of the valve, an improvement comprising:

a one-way clutch connected between an output shaft of the variable speed motor and the chuck assembly, and a manually rotatable knob separate from the means for releasing and connected to the chuck assembly, whereby said one-way clutch connects rotation of the output shaft of the variable speed motor to the chuck assembly when the output shaft rotates in one direction so that the valve may be surfaced and disconnects the output shaft of the variable speed motor from the chuck assembly when the chuck assembly is manually rotated by means of said knob to permit an operator to optically inspect the valve surface without disturbing the axial position of the valve relative to the chuck assembly.

* * * * *